US011424567B2

(12) United States Patent
Chien et al.

(10) Patent No.: US 11,424,567 B2
(45) Date of Patent: Aug. 23, 2022

(54) CONNECTOR STRUCTURE

(71) Applicant: Advanced Connectek Inc., New Taipei (TW)

(72) Inventors: Min-Lung Chien, New Taipei (TW); Fan-Cheng Huang, New Taipei (TW); Ying-Te Lin, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 17/105,514

(22) Filed: Nov. 26, 2020

(65) Prior Publication Data

US 2021/0167540 A1 Jun. 3, 2021

(30) Foreign Application Priority Data

Nov. 28, 2019 (TW) ..... 108215800

(51) Int. Cl.
*H01R 13/405* (2006.01)
*H01R 13/504* (2006.01)
*H01R 13/6585* (2011.01)

(52) U.S. Cl.
CPC ..... *H01R 13/405* (2013.01); *H01R 13/504* (2013.01); *H01R 13/6585* (2013.01)

(58) Field of Classification Search
CPC .... H01R 13/405; H01R 13/504; H01R 13/52; H01R 13/5202; H01R 13/6585; H01R 33/965
See application file for complete search history.

(56) References Cited

U.S. PATENT DOCUMENTS

| | | | | |
|---|---|---|---|---|
| 9,112,296 | B2 * | 8/2015 | Zhang | H01R 13/516 |
| 2013/0183844 | A1 * | 7/2013 | Wang | H01R 24/68 439/271 |
| 2013/0183867 | A1 * | 7/2013 | Wu | H01R 13/5202 439/668 |
| 2014/0127923 | A1 * | 5/2014 | Kuo | H01R 13/5202 439/271 |
| 2014/0302709 | A1 * | 10/2014 | Zhao | H01R 13/5202 439/519 |
| 2016/0006195 | A1 * | 1/2016 | Zhao | H01R 13/504 439/676 |
| 2016/0164218 | A1 * | 6/2016 | Lee | H01R 13/5202 439/587 |

* cited by examiner

*Primary Examiner* — Oscar C Jimenez
(74) *Attorney, Agent, or Firm* — JCIPRNET

(57) ABSTRACT

A connector structure is provided, including an insulating body, a plurality of terminals disposed in the insulating body, at least one stopper, and a housing receiving the insulating body and the terminals. A portion of the insulating body is abutted between the housing and the at least one stopper, and contacting portions of the housing and the at least one stopper are structurally combined together.

19 Claims, 10 Drawing Sheets

CONNECTOR STRUCTURE

CROSS-REFERENCE TO RELATED APPLICATION

This application claims the priority benefit of Taiwan application serial no. 108215800, filed on Nov. 28, 2019. The entirety of the above-mentioned patent application is hereby incorporated by reference herein and made a part of this specification.

BACKGROUND

Technical Field

The disclosure relates to a connector structure.

Related Art

With the development of science and technology, a variety of connectors for different electronic products have emerged. USB connector is one of the most widely used and popular connectors among electrical connectors. Most electronic devices are equipped with USB connectors. At present, USB Type-C connector has been widely used as a connector that enables reversible plug orientation.

Nonetheless, with the miniaturization of products, some components or structures cannot maintain their structural strength or desired functions when they are reduced in size. For example, structural features required for some components to be combined with others, such as a latching hook or a buckle hole or the like, cannot be fabricated smoothly during miniaturization. An existing connector may thus discards some structural features. As a result, problems may arise and cause defects of the connector.

SUMMARY

The disclosure provides a connector structure which maintains its structural strength during miniaturization to prevent components from falling off.

A connector structure of the disclosure includes an insulating body, a plurality of terminals, at least one stopper, and a housing. The plurality of terminals are disposed in the insulating body. The housing receives the insulating body and the plurality of terminals. A portion of the insulating body is abutted between the housing and the at least one stopper, and contacting portions of the housing and the at least one stopper are structurally combined together.

In an embodiment of the disclosure, the insulating body has a base portion and a tongue portion. The plurality of terminals respectively extend from the base portion to the tongue portion. The tongue portion is inserted through the housing. The base portion stands at an opening on one side of the housing. A portion of the base portion is sandwiched between the housing and the at least one stopper.

In an embodiment of the disclosure, the housing has a first recess. The insulating body has a tongue portion, a first base portion, and a second base portion. The tongue portion extends from the first base portion. The second base portion is stacked on one side of the first base portion facing away from the tongue portion. The tongue portion extends into the housing. The first base portion is accommodated in the first recess.

In an embodiment of the disclosure, the first base portion and a side surface of the housing are coplanar on a plane. The at least one stopper is stacked on the plane.

In an embodiment of the disclosure, the at least one stopper exposes the second base portion.

In an embodiment of the disclosure, the housing further has at least one convex part located on an edge of the side surface. The at least one stopper has at least one second recess accommodating the at least one convex part.

In an embodiment of the disclosure, the insulating body has at least one recess, and the at least one stopper has at least one convex part extending into the at least one recess and contacting the housing.

In an embodiment of the disclosure, the at least one stopper has a plate body abutting against the insulating body. The at least one convex part extends from the plate body. Another connector is adapted to butt the connector structure along an axial direction. An extension direction of the at least one convex part is parallel to the axial direction.

In an embodiment of the disclosure, one side of the insulating body and one side of the housing are flush with each other, and the plate body protrudes from the one side of the housing.

In an embodiment of the disclosure, the housing has at least one recess, and the at least one stopper has at least one convex part adapted to and contacting the at least one recess.

In an embodiment of the disclosure, the insulating body has at least one other convex part. The at least one convex part of the at least one stopper and the at least one other convex part of the insulating body are accommodated in the at least one recess. The at least one other convex part of the insulating body is sandwiched between the housing and the at least one convex part of the at least one stopper.

In an embodiment of the disclosure, the at least one stopper and the insulating body are flush with each other on the same side of the housing.

In an embodiment of the disclosure, the housing has at least one recess. The at least one stopper is entirely accommodated in the at least one recess and contacts the housing.

In an embodiment of the disclosure, the connector structure includes a pair of stoppers, contacting the housing from both opposite sides of the insulating body and sandwiching the insulating body between the pair of stoppers and the housing.

In an embodiment of the disclosure, contacting surfaces of the at least one stopper and the housing form a welded part and are structurally combined together.

In an embodiment of the disclosure, the at least one stopper and the insulating body are fitted to each other to form an integrated structure.

In an embodiment of the disclosure, the housing and the at least one stopper are a thin shell formed by metal welding for accommodating the insulating body and the plurality of terminals, and the insulating body is fixed to the thin shell.

Based on the above, in the connector structure, while the insulating body and the terminals are accommodated in the housing, contacting portions of the stopper and the housing are structurally combined together such that the insulating body is abutted or sandwiched between the housing and the stopper. Accordingly, by combining the stopper with the housing, a desired fixing effect is given to the insulating body. Meanwhile, when the connector structure butts another connector, the fixing effect further prevents the possibility of the insulating body being displaced relative to or falling off the housing. Thereby, the connector structure can be smoothly miniaturized regardless of some structural characteristics discarded during miniaturization. Consequently, the connector structure is enhanced in both size and structural strength.

DESCRIPTION OF THE EMBODIMENTS

Figure 1A:
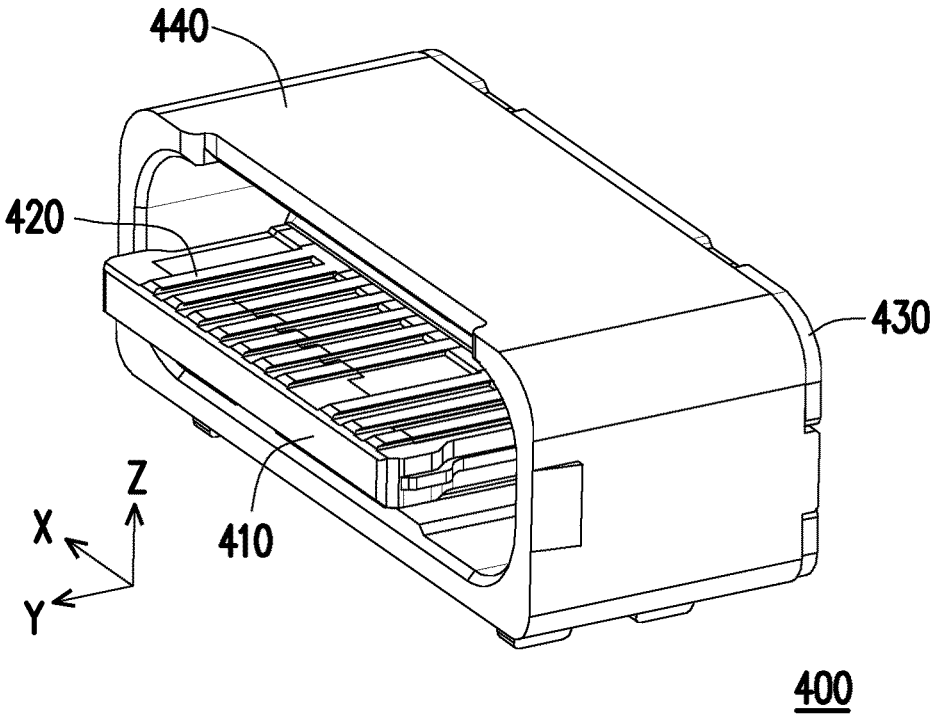
FIG. 1A is a schematic view of a connector structure according to an embodiment of the disclosure.
Figure 1B:
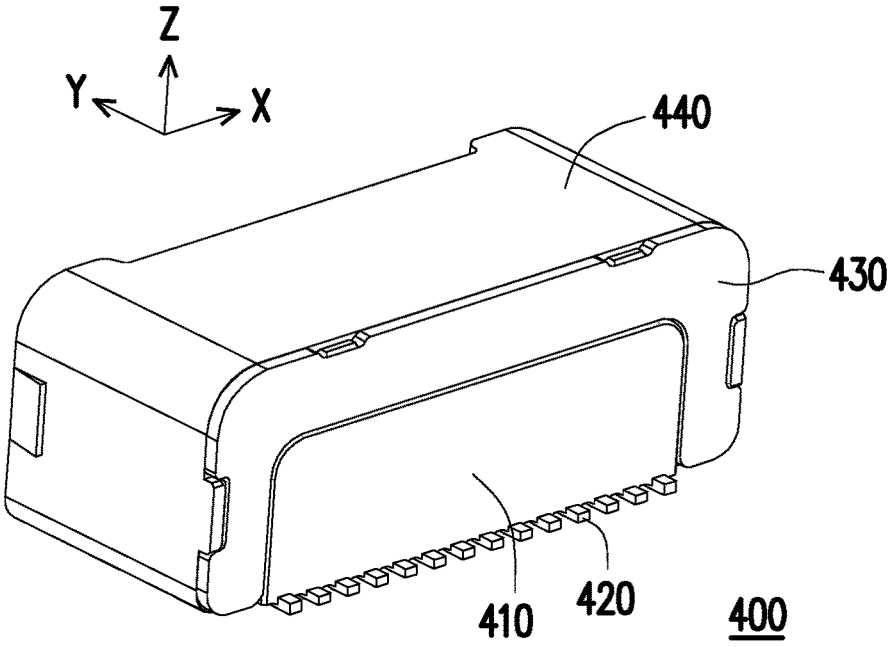
FIG. 1B illustrates the connector structure of FIG. 1A from another viewing angle.
Figure 1C:
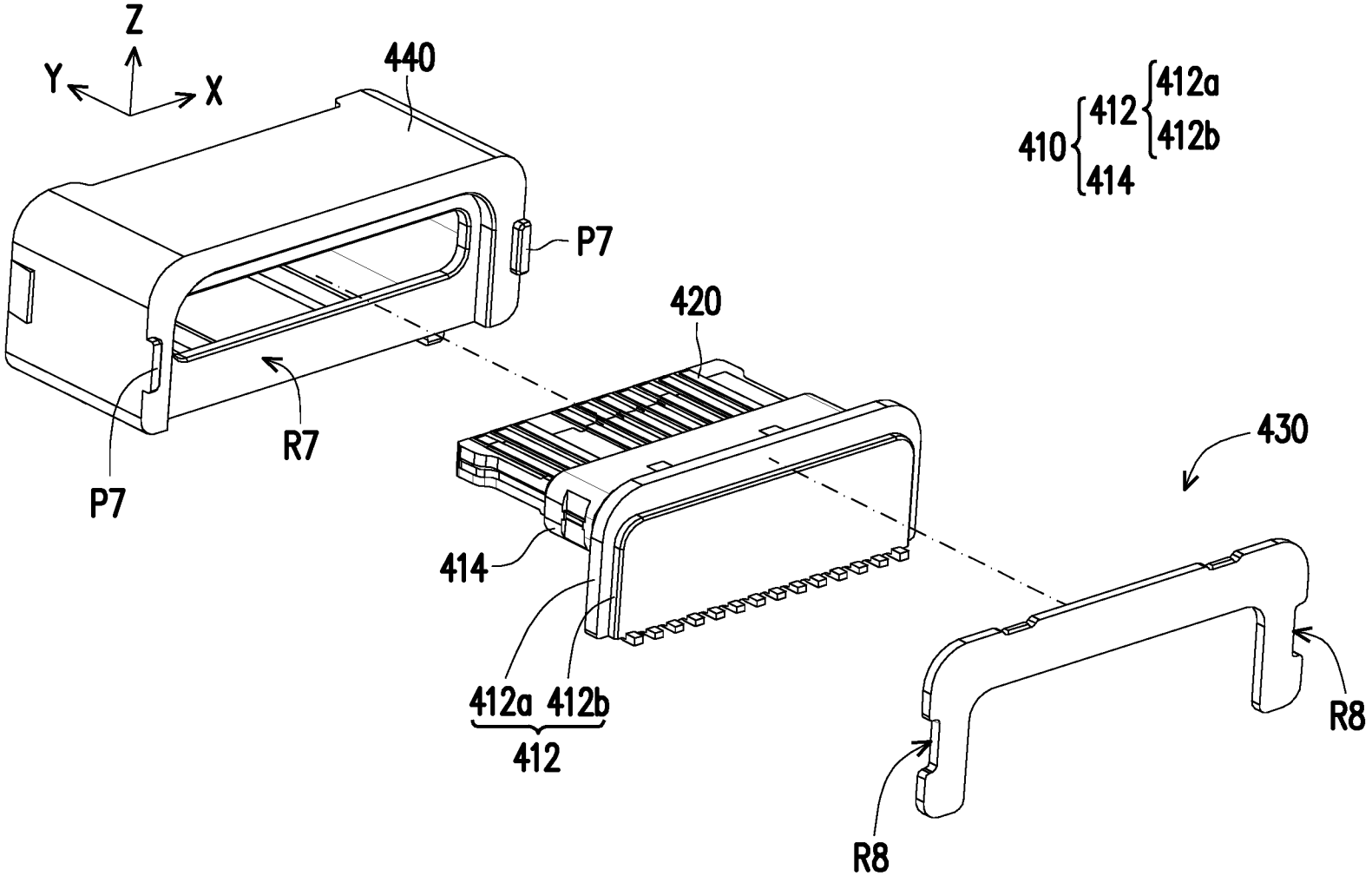
FIG. 1C is an exploded view of the connector structure of FIG. 1B.

FIG. 1A is a schematic view of a connector structure according to an embodiment of the disclosure. FIG. 1B illustrates the connector structure of FIG. 1A from another viewing angle. FIG. 1C is an exploded view of the connector structure of FIG. 1B. Here, Cartesian coordinates X-Y-Z are provided for the convenience of description of components. Referring to FIG. 1A to FIG. 1C together, in this embodiment, a connector structure 400 includes an insulating body 410, a plurality of terminals 420, at least one stopper (a stopper 430 is described as an example), and a housing 440. The terminals 420 are disposed in the insulating body 410 and are respectively exposed from both opposite sides of the insulating body 410 along the Y axis. The housing 440 receives the insulating body 410 and the terminals 420 therein. A portion of the insulating body 410 is abutted between the housing 440 and the stopper 430, and contacting portions of the housing 440 and the stopper 430 are structurally combined together.

Figure 1D:
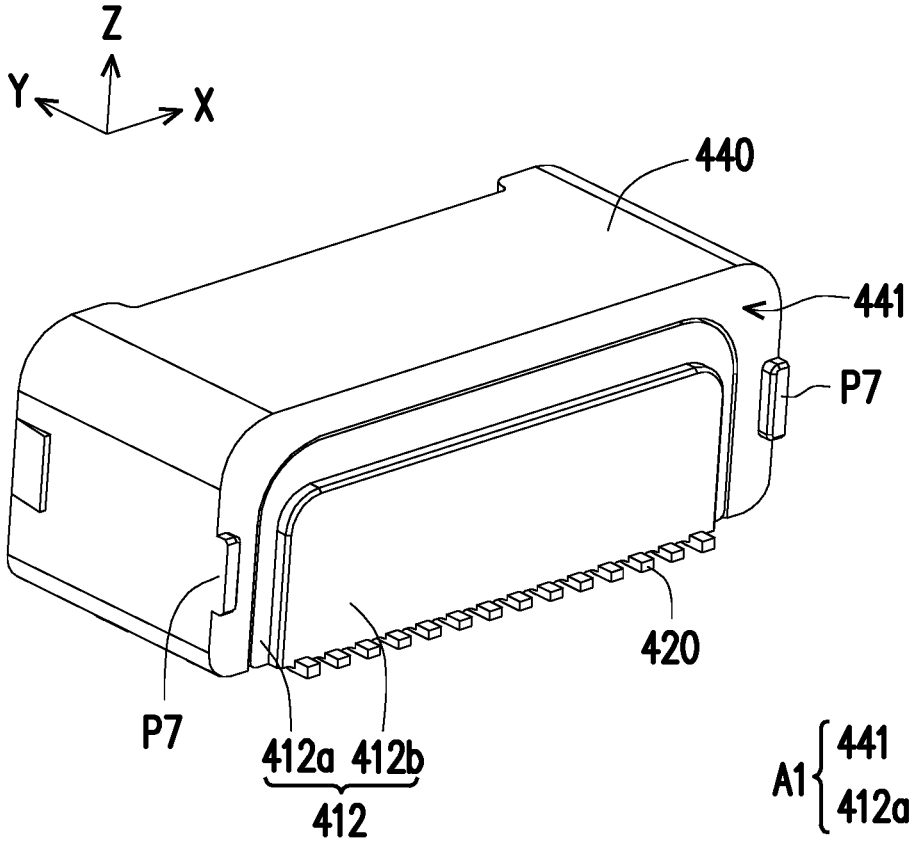
FIG. 1D is a schematic view of some components of the connector structure of FIG. 1B.

FIG. 1C is an exploded view of the connector structure of FIG. 1B. FIG. 1D is a schematic view of some components of the connector structure of FIG. 1B. Referring to FIG. 1B to FIG. 1D together, in this embodiment, the insulating body 410 includes a tongue portion 414 and a base portion 412. The insulating body 410 further includes a thickened step portion which is located at a root portion of the tongue portion 414 and adjacent to the base portion 412. Here, the base portion 412 is further divided into a first base portion 412*a* and a second base portion 412*b*, wherein the terminals 420 respectively extend from the second base portion 412*b* and the first base portion 412*a* to the tongue portion 414 and are exposed on both opposite sides of the tongue portion 414. The tongue portion 414 is inserted through an inner space of the housing 440. The first base portion 412*a* and the second base portion 412*b* stand at an opening on one side of the housing 440, and the first base portion 412*a* is sandwiched between the housing 440 and the stopper 430. Here, the tongue portion 414 extends from the first base portion 412*a*, and the second base portion 412*b* is stacked on one side of the first base portion 412*a* facing away from the tongue portion 414. Accordingly, when the tongue portion 414 extends into the housing 440, the first base portion 412*a* is accommodated in a first recess R7 of the housing 440.

As shown in FIG. 1D, when the insulating body 410 and the housing 440 are assembled together, the first base portion 412*a* is accommodated in the first recess R7 and forms a plane A1 with a side surface 441 of the housing 440. The stopper 430 is substantially stacked on the plane A1 and thus exposes the second base portion 412*b*. In addition, the housing 440 further has a pair of convex parts P7 located on an edge of the side surface 441. The stopper 430 has a pair of second recesses R8, so that the convex parts P7 can be accommodated in the second recesses R8 after the stopper 430 is assembled to the housing 440. Accordingly, after the assembly of the above components, contacting portions of the stopper 430 and the housing 440 are further structurally combined together by laser welding, thereby enabling the stopper 430 to stop the insulating body 410.

Figure 2A:
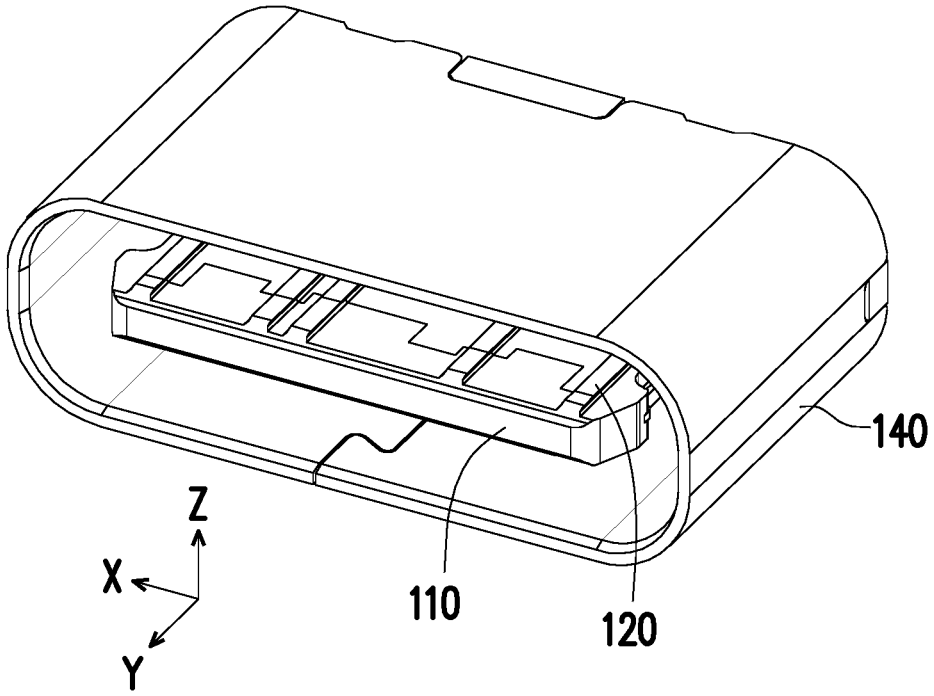
FIG. 2A is a schematic view of a connector structure according to an embodiment of the disclosure.
Figure 2B:
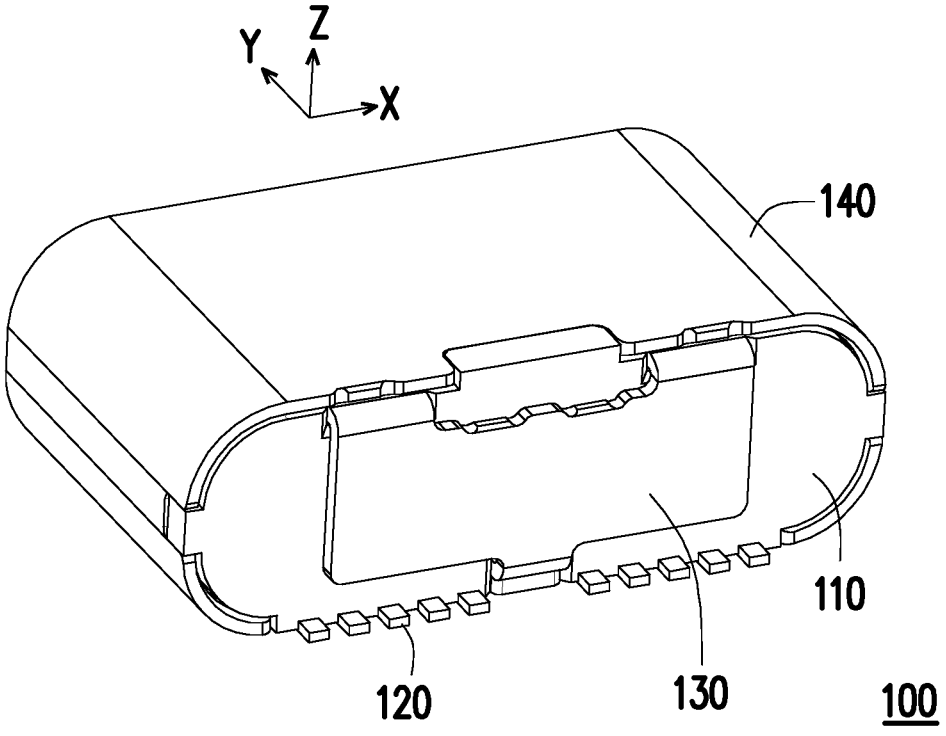
FIG. 2B illustrates the connector structure of FIG. 2A from another viewing angle.
Figure 3A:
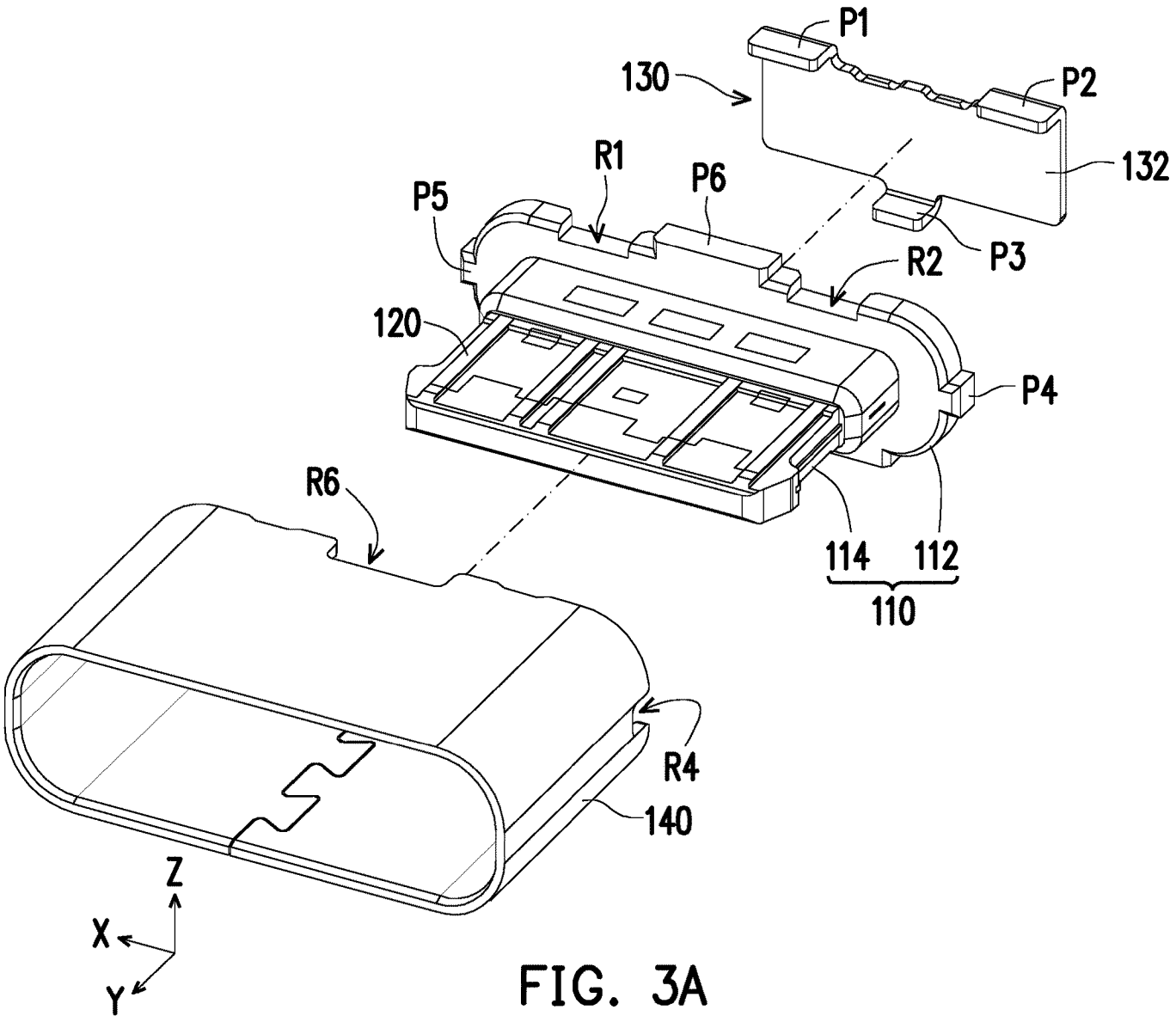
FIG. 3A is an exploded view of the connector structure of FIG. 1A.

FIG. 2A is a schematic view of a connector structure according to an embodiment of the disclosure. FIG. 2B illustrates the connector structure of FIG. 2A from another viewing angle. FIG. 3A is an exploded view of the connector structure of FIG. 2A. Referring to FIG. 2A, FIG. 2B and FIG. 3A together, in this embodiment, a connector structure 100 includes an insulating body 110, a plurality of terminals 120, at least one stopper (a stopper 130 is described as an example), and a housing 140. The terminals 120 are disposed in the insulating body 110 and are respectively exposed from both opposite sides of the insulating body 110 along the Y axis. The housing 140 receives the insulating body 110 and the terminals 120 therein. A portion of the insulating body 110 is abutted between the housing 140 and the stopper 130, and contacting portions of the housing 140 and the stopper 130 are structurally combined together.

Figure 3B:
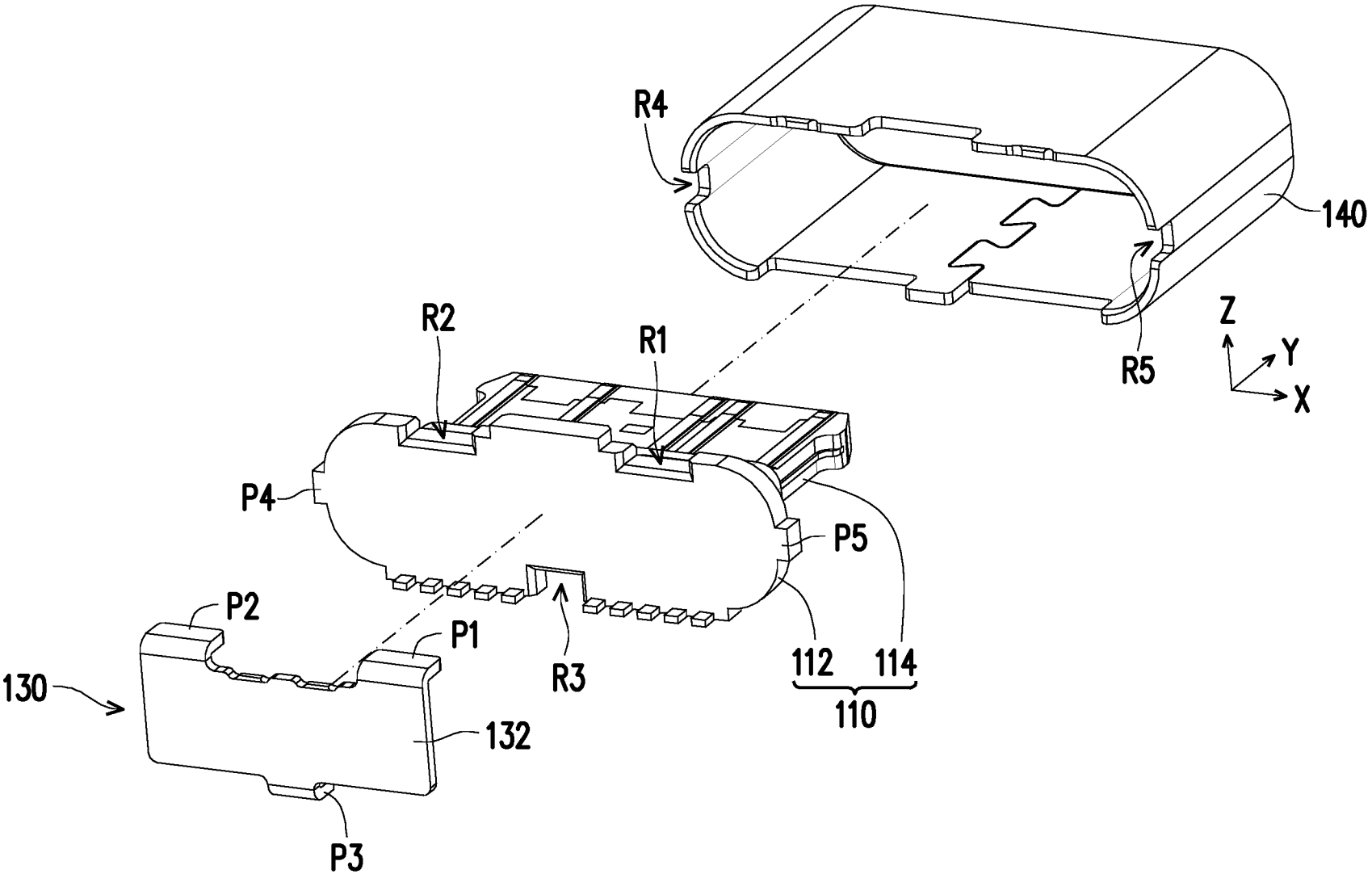
FIG. 3B illustrates the connector structure of FIG. 3A from another viewing angle.

FIG. 3B illustrates the connector structure of FIG. 3A from another viewing angle. Referring to FIG. 3A and FIG. 3B together, in detail, the insulating body 110 includes a base portion 112 and a tongue portion 114, a portion of the terminals 120 is exposed on both sides of the tongue portion 114, and another portion of the terminals 120 is retained inside the base portion 112. The connector structure 100 further includes a mid-plate which is retained inside the tongue portion 114 and between the terminals 120 on both sides of the tongue portion 114. Lateral side edges of the mid-plate are respectively exposed on lateral sides of the tongue portion 114 or respectively protruded out lateral sides of the tongue portion. The mid-plate is embedded inside a middle level of the tongue portion 114.

The insulating body 110 further has recesses R1, R2 and R3 and convex parts P4, P5 and P6 located on the base portion 112. The stopper 130 has a plate body 132 and convex parts P1, P2 and P3 extending from the plate body 132. The housing 140 has recesses R4, R5 and R6. Accordingly, when the housing 140, the insulating body 110 and the stopper 130 are combined with one another, the convex parts P4, P5 and P6 of the insulating body 110 are correspondingly fitted into the recesses R4, R5 and R6 of the housing 140, and the convex parts P1, P2 and P3 of the stopper 130 respectively and correspondingly extend into the recesses R1, R2 and R3 of the insulating body 110. After extending into the recesses R1, R2 and R3, the convex parts P1, P2 and P3 contact an inner wall of the housing 140.

In this embodiment, contacting surfaces of the stopper 130 and the housing 140 form a welded part and are structurally combined together. That is, in the convex parts P1, P2 and P3 that have extended into the recesses R1, R2 and R3, the portions in contact with the inner wall of the housing 140 are combined together by, for example, laser welding. Accordingly, the housing 140 and the stopper 130, both made of metal, are welded to form a thin shell which is configured to accommodate the insulating body 110 and the terminals 120 and also to fix the insulating body 110 to the thin shell.

In other words, the insulating body 110 of this embodiment provides a recess at the base portion 112 for allowing the convex parts P1, P2 and P3 to pass through, and an internal space of the housing 140 is used for allowing the stopper 130 to be combined with the housing 140. In this way, the connector structure 100 can be effectively reduced in size to achieve miniaturization. The size mentioned here refers to a length of the connector structure 100 along the Y axis. As shown in FIG. 2B, one side of the insulating body 110 and one side of the housing 140 are flush with each other, and the plate body 132 protrudes from the one side of the housing 140. However, by using the internal space of the housing 140 as above, the length of the housing 140 along the Y axis can be reduced compared to an existing connector structure. Meanwhile, the welded part formed by contacting the convex parts P1, P2 and P3 with the inner wall of the housing 140 is capable of maintaining the required structural strength due to the structural combination, thereby firmly fixing the insulating body 110 between the stopper 130 and the housing 140. Further, by the stopper 130 stopping the insulating body 110, the insulating body 110 is prevented from being displaced relative to or falling off the housing 140. Here, the convex parts P1, P2 and P3 extend relative to the plate body 132 along the Y axis, and another connector butts the connector structure 100 along the Y axis. That is, an extension direction of the convex parts P1, P2 and P3 is parallel to a butt axis (Y axis) of the connector structure 100.

In another embodiment not shown, to simplify the assembly process of the connector structure 100, the insulating body 110 and the stopper 130 may form an integrated structure by fitting the convex parts P1, P2 and P3 into the recesses R1, R2 and R3. That is, the stopper 130 and the insulating body 110 may first be combined into a semi-finished product by, for example, insert molding. After that, the manufacture of the connector structure 100 can be completed simply by combining the housing 140 with the semi-finished product and welding them together. However, the manufacturing process of the connector structure of the disclosure is not thereby limited.

Figure 4:
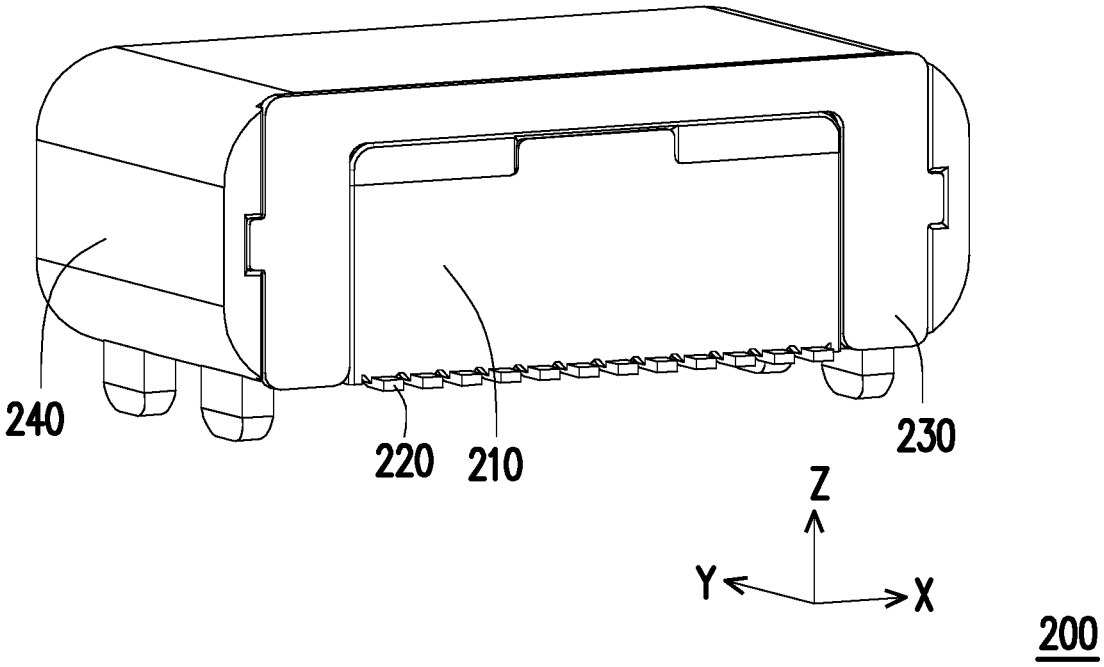
FIG. 4 is a schematic view of a connector structure according to another embodiment of the disclosure.
Figure 5:
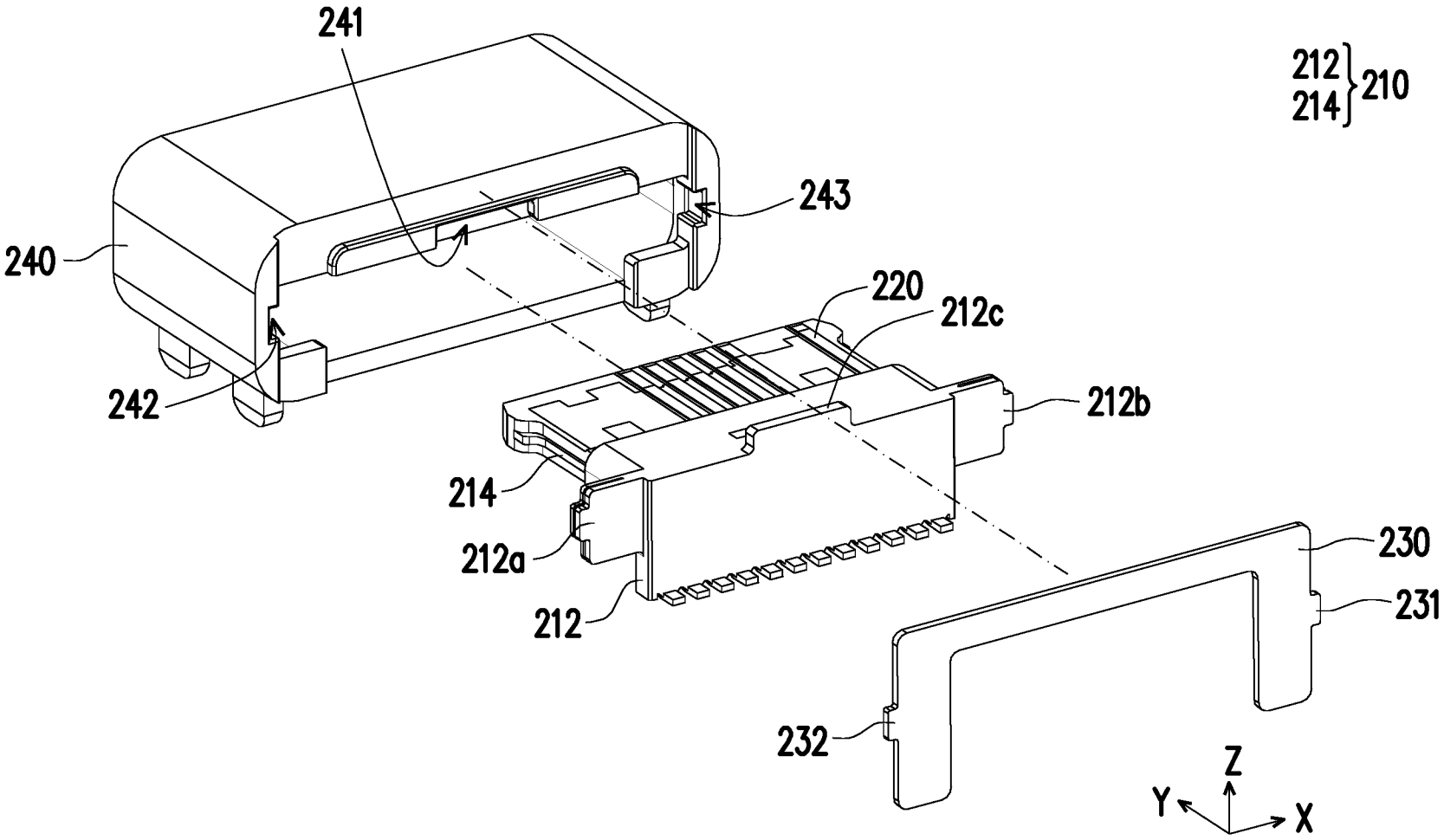
FIG. 5 is an exploded view of the connector structure of FIG. 4.

FIG. 4 is a schematic view of a connector structure according to another embodiment of the disclosure. FIG. 5 is an exploded view of the connector structure of FIG. 4. Referring to FIG. 4 and FIG. 5 together, in this embodiment, a connector structure 200 includes a housing 240, an insulating body 210, terminals 220, and a stopper 230, wherein the terminals 220 are similar to the terminals 120 and a description thereof will be omitted. Unlike the previous embodiment, the housing 240 of this embodiment has recesses 241, 242 and 243, the stopper 230 has convex parts 231 and 232, and the insulating body 210 includes a base portion 212 and a tongue portion 214 and further has convex parts 212*a*, 212*b* and 212*c* located on the base portion 212. Accordingly, when the housing 240, the insulating body 210 and the stopper 230 are combined with one another, the convex parts 212*a*, 212*b* and 212*c* are correspondingly accommodated in the recesses 242, 243 and 241, and the convex parts 231 and 232 are correspondingly accommodated in and adapted to the recesses 243 and 242. As a result, the stopper 230 is in surface contact with the housing 240.

Since the convex parts 231 and 232 and the convex part 212*b* and 212*a* are correspondingly accommodated in the recesses 243 and 242, after contacting surfaces of the stopper 230 and the housing 240 are welded, the insulating body 210 can be fixed inside a thin shell formed by the housing 240 and the stopper 230 by the convex part 212*b* and 212*a* being sandwiched between the housing 240 and the convex parts 232, 231 of the stopper 230. Here, the stopper 230 is flush with the insulating body 210 on the same side of the housing 240, and the entire stopper 230 is substantially accommodated in a recess of the housing 240 and contacts the housing 240.

Figure 6:
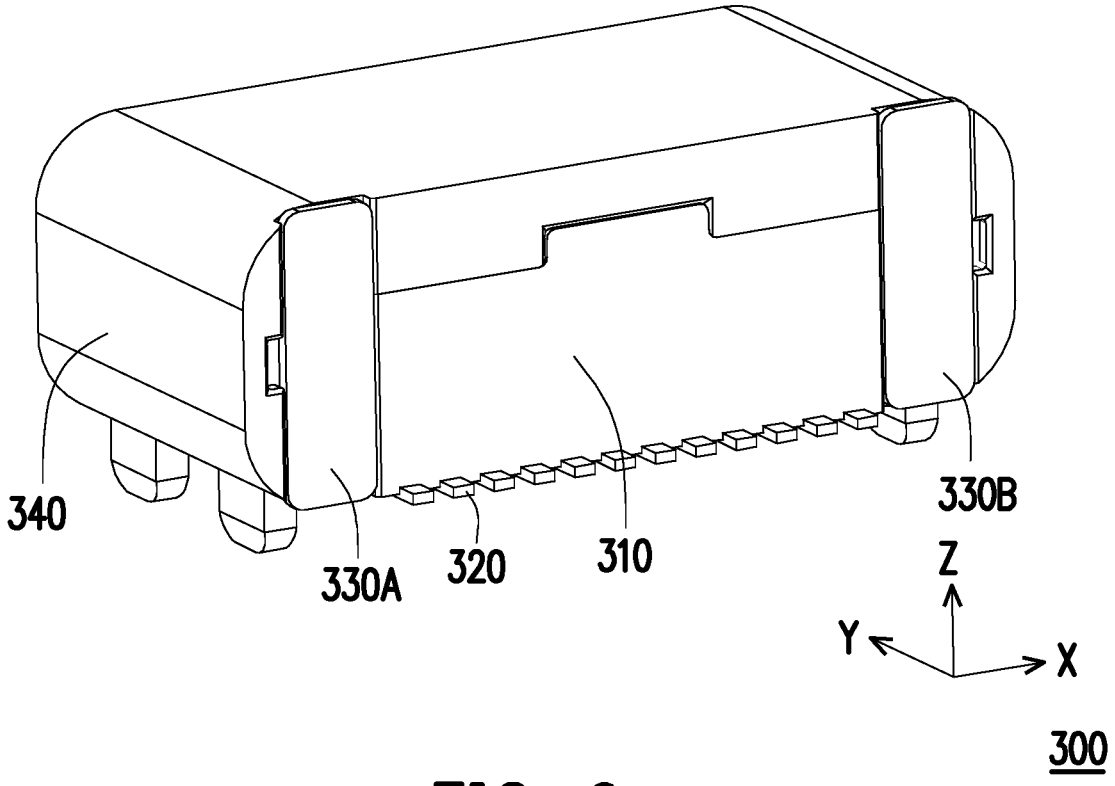
FIG. 6 is a schematic view of a connector structure according to still another embodiment of the disclosure.
Figure 7:
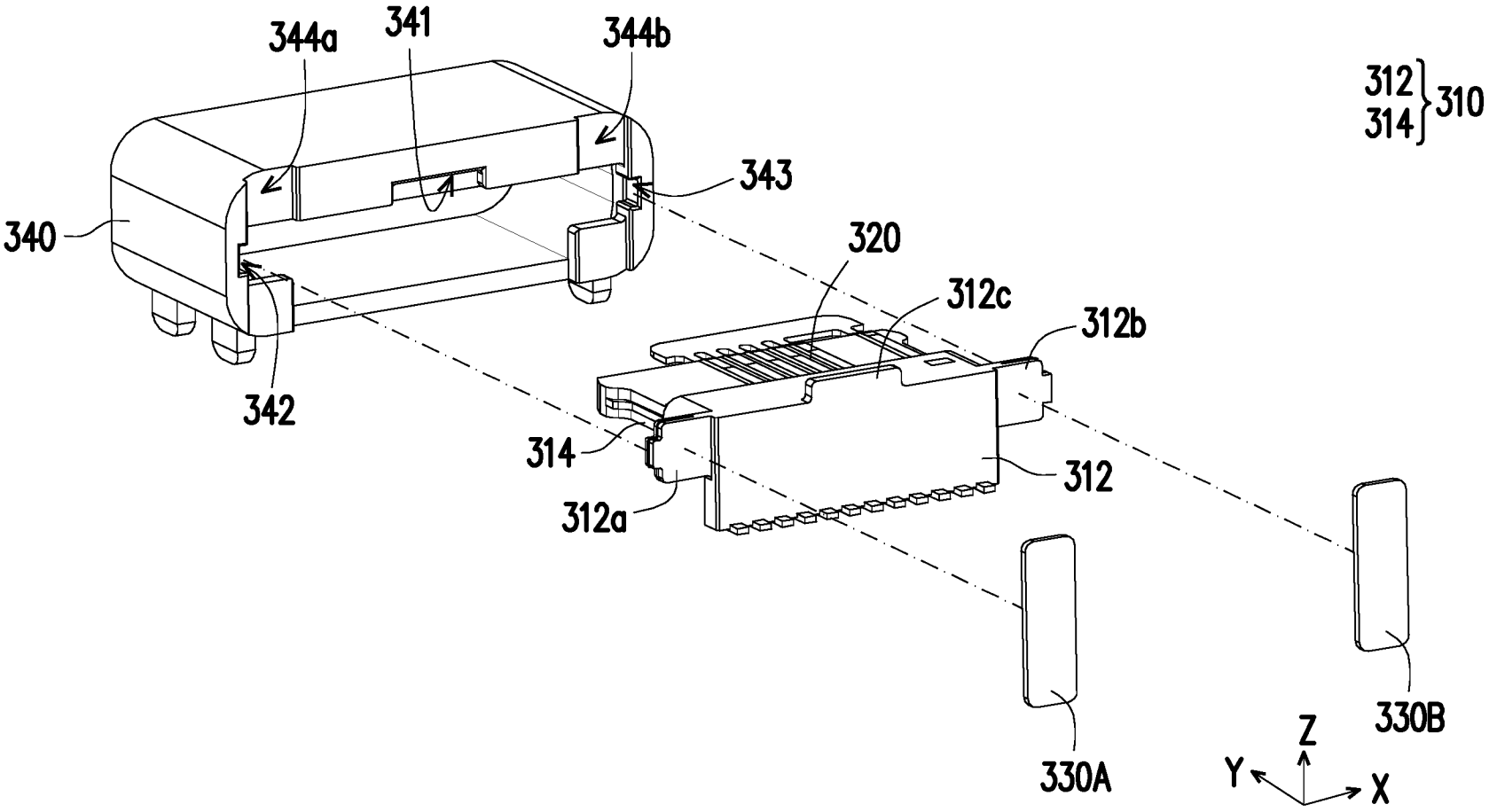
FIG. 7 is an exploded view of the connector structure of FIG. 6.

FIG. 6 is a schematic view of a connector structure according to still another embodiment of the disclosure. FIG. 7 is an exploded view of the connector structure of FIG. 6. Referring to FIG. 6 and FIG. 7 together, a connector structure 300 of this embodiment includes a housing 340, an insulating body 310, terminals 320, and a pair of stoppers 330A and 330B, which are roughly similar to those shown in FIG. 4 and FIG. 5. A difference is that the stoppers 330A and 330B are disposed from both opposite sides of the insulating body 310 along the X axis to contact the housing 340 along the Y axis, and the insulating body 310 is sandwiched between the stoppers 330A, 330B and the housing 340.

Further, as shown in FIG. 7, the housing 340 has recesses 341, 342, 343, 344*a* and 344*b*, and the insulating body 310 includes a base portion 312 and a tongue portion 314 and further includes convex parts 312*a*, 312*b* and 312*c* located on the base portion 312. When the stopper 330A and 330B, the insulating body 310 and the housing 340 are combined with one another the convex parts 312*a*, 312*b* and 312*c* are correspondingly accommodated in the recesses 342, 343 and 341, and the stoppers 330A and 330B are respectively entirely accommodated in the recesses 344*a* and 344*b*, such that the convex part 312*a* is sandwiched between the stopper 330A and the housing 340, and the convex part 312*b* is sandwiched between the stopper 330B and the housing 340.

Similarly to the previous embodiment of FIG. 4 and FIG. 5, the stopper 330A and 330B are in surface contact with one side of the housing 340, and the insulating body 310 and the stoppers 330A and 330B are flush with one side of the housing 340 at the same time. Therefore, by subsequent welding, the stoppers 330A and 330B and the housing 340 can be structurally combined, and the insulating body 310 can be fixed in a thin shell structure after welding.

In summary, in the above-mentioned embodiments of the disclosure, in the connector structure, while the insulating body and the terminals are accommodated in the housing, contacting portions of the stopper and the housing are structurally combined together such that the insulating body is abutted or sandwiched between the housing and the stopper. Accordingly, by combining the stopper with the housing, a desired fixing effect is given to the insulating body. Meanwhile, when the connector structure butts another connector, the fixing effect further prevents the possibility of the insulating body being displaced relative to or falling off the housing. Thereby, the connector structure can be smoothly miniaturized regardless of some structural characteristics discarded during miniaturization. Consequently, the connector structure is enhanced in both size and structural strength.

What is claimed is:

1. A connector structure comprising:

an insulating body;

a plurality of terminals disposed in the insulating body;

at least one stopper; and a housing receiving the insulating body and the plurality of terminals, wherein a portion of the insulating body is abutted between the housing and the at least one stopper, and contacting portions of the housing and the at least one stopper are structurally combined together, wherein the housing has a first recess, the insulating body has a tongue portion, a first base portion, and a second base portion, the tongue portion extends from the first base portion, the second base portion is stacked on one side of the first base portion facing away from the tongue portion, the tongue portion extends into the housing, and the first base portion is accommodated in the first recess, wherein the housing stops the first base portion from entering a through hole of the housing via a structure forming the first recess, but allows the tongue portion inserting into the through hole of the housing.

2. The connector structure according to claim 1, wherein the plurality of terminals respectively extend from the second base portion to the tongue portion, the second base portion stands at an opening on one side of the housing, and a portion of the first base portion is sandwiched between the housing and the at least one stopper.

3. The connector structure according to claim 1, wherein the first base portion and a side surface of the housing are coplanar on a plane, and the at least one stopper is stacked on the plane.

4. The connector structure according to claim 3, wherein the at least one stopper exposes the second base portion.

5. The connector structure according to claim 3, wherein the housing further has at least one convex part located on an edge of the side surface, and the at least one stopper has at least one second recess accommodating the at least one convex part.

6. The connector structure according to claim 1, wherein the insulating body has at least one recess, the at least one stopper has at least one convex part extending into the at least one recess and contacting the housing.

7. The connector structure according to claim 6, wherein the at least one stopper has a plate body abutting against the insulating body, the at least one convex part extends from the plate body, another connector is adapted to butt the connector structure along an axial direction, and an extension direction of the at least one convex part is parallel to the axial direction.

8. The connector structure according to claim 7, wherein one side of the insulating body and one side of the housing are flush with each other, and the plate body protrudes from the one side of the housing.

9. The connector structure according to claim 1, wherein the housing has at least one another recess, the at least one stopper has at least one convex part, and the at least one convex part is adapted to the at least one recess such that the at least one stopper is in surface contact with the housing.

10. The connector structure according to claim 9, wherein the insulating body has at least one other convex part, the at least one convex part of the at least one stopper and the at least one other convex part of the insulating body are accommodated in the at least one another recess, and the at least one other convex part of the insulating body is sandwiched between the housing and the at least one convex part of the at least one stopper.

11. The connector structure according to claim 1, wherein the at least one stopper is flush with the insulating body on the same side of the housing.

12. The connector structure according to claim 1, wherein the at least one stopper is entirely accommodated in the first recess and contacts the housing.

13. The connector structure according to claim 1, comprising a pair of stoppers, contacting the housing from both opposite sides of the insulating body and sandwiching the insulating body between the pair of stoppers and the housing.

14. The connector structure according to claim 1, wherein contacting surfaces of the at least one stopper and the housing form a welded part and are structurally combined together.

15. The connector structure according to claim 1, wherein the at least one stopper and the insulating body are fitted to each other and form an integrated structure.

16. The connector structure according to claim 1, wherein the housing and the at least one stopper are a thin shell formed by metal welding for accommodating the insulating body and the plurality of terminals, and the insulating body is fixed to the thin shell.

17. The connector structure according to claim 1, further comprising a mid-plate retained inside the tongue portion and lateral side edges of the mid-plate respectively exposed on lateral sides of the tongue portion or respectively protruded out lateral sides of the tongue portion.

18. The connector structure according to claim 1, further comprising a mid-plate embedded inside a middle level of the tongue portion.

19. The connector structure according to claim 1, wherein the insulating body further comprises a thickened step portion which is located at a root portion of the tongue portion and adjacent to the first base portion.

* * * * *